US011448228B2

(12) United States Patent
Huang et al.

(10) Patent No.: US 11,448,228 B2
(45) Date of Patent: Sep. 20, 2022

(54) PUMPS WITH A WATERPROOF STRUCTURE

(71) Applicant: BESTWAY INFLATABLES & MATERIAL CORP., Shanghai (CN)

(72) Inventors: Shuiyong Huang, Shanghai (CN); Jinnian Wang, Shanghai (CN); Guoping Li, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 214 days.

(21) Appl. No.: 16/268,000

(22) Filed: Feb. 5, 2019

(65) Prior Publication Data

US 2019/0242395 A1 Aug. 8, 2019

(30) Foreign Application Priority Data

Feb. 5, 2018 (CN) ..... 201820195113.5

(51) Int. Cl.

| | |
|---|---|
| ***F04D 29/10*** | (2006.01) |
| ***F04D 13/06*** | (2006.01) |
| ***F04D 29/12*** | (2006.01) |
| ***F04D 29/42*** | (2006.01) |
| *F04D 29/00* | (2006.01) |
| *F04D 29/043* | (2006.01) |

(52) U.S. Cl.

CPC ..... *F04D 29/106* (2013.01); *F04D 13/06* (2013.01); *F04D 29/126* (2013.01); *F04D 29/426* (2013.01); *F04D 29/007* (2013.01); *F04D 29/043* (2013.01)

(58) Field of Classification Search

CPC ..... F04D 29/106; F04D 29/126; F04D 13/06; F04D 29/12; F04D 29/146; F04D 29/043; F04D 29/08; F04D 29/086; F04D 29/10; F04D 29/007

USPC ..... 417/423.3

See application file for complete search history.

(56) References Cited

U.S. PATENT DOCUMENTS

| | | | | | |
|---|---|---|---|---|---|
| 2,375,085 | A * | 5/1945 | Curtis | F04D 29/126 | 277/393 |
| 5,171,126 | A * | 12/1992 | Becker | F04D 29/126 | 415/121.2 |
| 5,261,676 | A * | 11/1993 | Rockwood | H02K 49/106 | 277/389 |
| 5,567,132 | A * | 10/1996 | Dupuis | F04D 29/061 | 277/910 |

(Continued)

*Primary Examiner* — Nathan C Zollinger
*Assistant Examiner* — Timothy P Solak
(74) *Attorney, Agent, or Firm* — Dickinson Wright PLLC

(57) ABSTRACT

A motor driven pump with a waterproof structure is provided. The pump includes a motor, a pump body, a pump shaft, a shaft seal, and a first blocking member. The motor includes a motor housing. The pump body includes an impeller and a first drainage chamber having a first drainage outlet. The pump shaft includes a first end and a second end located opposite to the first end, wherein the first end is connected to the motor and the second end is connected to the impeller. The shaft seal forms a fluid seal with the pump body to prevent a fluid in the pump body from leaking into the motor. The first blocking member is located between the motor and the shaft seal and is connected in a sealed and a fixed manner to the pump shaft for conjoint rotation. The first blocking member is positioned to block fluid leaking from the shaft seal.

13 Claims, 9 Drawing Sheets

(56) References Cited

U.S. PATENT DOCUMENTS

| | | | | |
|---|---|---|---|---|
| 6,402,461 | B1 * | 6/2002 | Tebby | F16J 15/3404 415/58.2 |
| 2003/0001341 | A1 * | 1/2003 | Sakata | F16J 15/3264 277/423 |
| 2006/0198743 | A1 * | 9/2006 | Taga | F04D 29/108 417/423.1 |
| 2007/0114168 | A1 * | 5/2007 | Hazlehurst | B01D 35/26 210/416.2 |
| 2012/0134789 | A1 * | 5/2012 | Murakami | F04D 13/02 415/182.1 |

* cited by examiner

PUMPS WITH A WATERPROOF STRUCTURE

CROSS-REFERENCE TO RELATED APPLICATION

This U.S. patent application claims priority to and the benefit of Chinese patent application number 201820195113.5, filed Feb. 5, 2018, the entire disclosure of which is incorporated herein by reference.

BACKGROUND OF THE INVENTION

1. Field of the Invention

The present disclosure relates to a pump, and more particularly to a pump with a waterproof structure that includes at least one blocking member.

2. Related Art

This section provides background information related to the present disclosure which is not necessarily prior art.

In order to prevent water in a pump body from leaking into the motor, traditional pumps generally include a shaft seal placed around a pump shaft between the pump housing and the motor. However, after a certain amount of use, the shaft seal may become damaged, which may cause fluid in the pump body to leak and damage interrelated parts, such as the pump motor. Attempts to avoid this leakage have included incorporating a lip seal. A lip seal may form a relatively impervious cavity with the pump shaft to constrain outflow of water and thus prevent unwanted leakage into interrelated parts. While these traditional seals offer certain improvements in the art, they are also known to suffer some drawbacks. For example, when the pump is in operation, an impeller is driven by a pump shaft that is rotated at a high speed relative to the lip seal causing wear. More specifically, the lip seal directly contacts with the pump shaft, so when the pump is in operation, the lip seal and the pump shaft develop a certain amount of friction therebetween, which can easily cause wear of the lip seal and lead to seal failure between the lip seal and the pump shaft. As a result, water leaking from the shaft seal can flow through the seal and into the motor, potentially damaging the motor and interrelated parts.

Even more problematic, water in the motor can cause the water to be charged and thus produce a safety hazard for electric shock. Therefore, there is a need in the art to design a pump that can effectively prevent water leaking from the shaft seal from flowing into the motor, thereby enabling longer and safer use of the pump.

SUMMARY OF THE INVENTION

This section provides a general summary of the disclosure and should not be interpreted as a complete and comprehensive listing of all of the objects, aspects, features and advantages associated with the present disclosure.

In order to solve at least the problem that a sealing structure is easy to be broken in the prior art, the present disclosure provides improved pumps with a waterproof structure.

According to one exemplary embodiment, the present disclosure provides a pump having a waterproof structure, comprising a motor having a motor housing, a pump body having an impeller and a first drainage chamber and a first drainage outlet, a pump shaft having a first end and a second end located opposite from the first end. The first end is connected to the motor and the second end is connected to the impeller and a shaft seal forms a fluid seal to prevent flow of a fluid through the shaft seal. A first blocking member located between the motor and the shaft seal, wherein the first blocking member is coupled around the pump shaft and creates a seal, and wherein the first blocking member is adapted to block any fluid leaking from the shaft seal and guide the leaking fluid flow through the first drainage chamber and the first drainage outlet.

According to one aspect of the present disclosure, the first blocking member includes an outer periphery that is at least partially received within the first drainage chamber.

According to another aspect, the first blocking member is annular.

According to yet another aspect, the first blocking member is annular.

According yet another aspect of the present disclosure, the first blocking member includes an inclined surface at least partially received within the first drainage chamber to guide the fluid blocked by the first blocking member to the first drainage chamber.

According yet another aspect, the pump further includes a second blocking member located between the motor and the first blocking member, wherein the second blocking member blocks any fluid that leaks by the first blocking member, and wherein the pump body includes a second drainage chamber and a second drainage outlet through which leaked fluid from the second blocking member is diverted.

In accordance to one embodiment of the present disclosure, the motor housing includes an opening portion allowing the pump shaft to pass therethrough and the pump further includes a third blocking member located around the opening portion and adapted to block any fluid leaking through the second blocking member and prevent the leaking fluid from entering the motor housing through the opening portion.

According to another embodiment of the present disclosure, the pump further comprises a reinforcing member connecting the first blocking member and the second blocking member.

According to yet another embodiment of the present disclosure, the first blocking member, the reinforcing member and the second blocking member comprise an integral member.

According to another embodiment of the present disclosure, the third blocking member extends axially to an outer edge and the second blocking member includes a cavity within which at least part of the outer edge of the third blocking member is received.

In accordance with yet another aspect, the third blocking member is attached to the motor housing and has a frustoconical shape extending radially outward to the outer edge, wherein the outer edge of the third blocking member is located adjacent to the second blocking member and within the cavity.

According to another aspect, the second blocking member includes a blocking surface facing the impeller and at least partially located within the second drainage chamber to block any fluid that leaks by the first blocking member.

According to one embodiment of the present disclosure, the pump body further comprises a pump body cover mounted over the first drainage chamber, the pump body cover including a first extension portion that extends toward the pump shaft and around at least a portion of the first blocking member to guide any fluid that leaks by the first blocking member to the first drainage chamber.

According to one embodiment of the present disclosure, the pump body cover includes a second extension portion that extends along an axis of the pump shaft; the second extension portion, the first extension portion, the reinforcing member and the second blocking member forming the second drainage chamber; and the second extension portion forming the second drainage outlet.

According to one embodiment of the present disclosure, the second blocking member includes a guiding surface adapted to guide any fluid leaking from the first drainage chamber through the second drainage chamber and the second drainage outlet.

According to one embodiment of the present disclosure, the second blocking member further includes a blocking surface adapted to block any fluid that is not guided to the second drainage chamber by the guiding surface.

According to another embodiment of the present disclosure, the second blocking member further includes a blocking surface adapted to block any fluid that is not guided to the second drainage chamber by the guiding surface.

According to one embodiment of the present disclosure, the first blocking member, the reinforcing member and the second blocking member form at least one aperture through which the shaft sleeve extends, the pump further including a sealing member that is located between the shaft sleeve and at least one of the first blocking member, the reinforcing member and the second blocking member to prevent fluid from leaking between the shaft sleeve and at least one aperture.

According to one embodiment, the present disclosure provides a pump comprising a motor having a motor housing including an opening portion, a pump body having an impeller, and a pump shaft having a first end and a second end located opposite from the first end. The first end is connected to the motor and the second end is connected to the impeller through the opening portion of the motor housing. A shaft seal forming a fluid seal to prevent a flow of fluid through the shaft seal. A first blocking member located between the motor and shaft seal and coupled around the pump shaft. A second blocking member adjacent to the first blocking member, wherein the first blocking member and the second blocking member are adapted to block any fluid leaking from the shaft seal. A third blocking member located around the opening portion and adapted to block and prevent flow into the opening portion of any fluid that is not blocked by the first blocking member and second blocking member.

According to one embodiment of the present disclosure, the third blocking member extends axially to an outer edge and the second blocking member comprises a cavity in which the outer edge of the third blocking member is at least partially located.

In accordance with yet another embodiment, the motor housing includes an opening portion and the pump shaft extends through the opening portion, the third blocking member is formed around the opening portion and extends radially outward and axially to form a frustoconical shape that terminates at the outer edge, wherein the cavity in the second blocking member includes an opening for insertion of at least part of the third blocking member, and the outer edge of the third blocking member is located in the cavity axially closer to the second blocking member than to the opening of the cavity.

Embodiments of pumps of the present disclosure may comprise a waterproof structure that may run synchronously with a pump shaft, which can effectively prevent fluid leaking from a shaft seal from flowing into a motor, thereby preventing contact between water and electricity and avoiding the risk of electric shock.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

Figure 1:
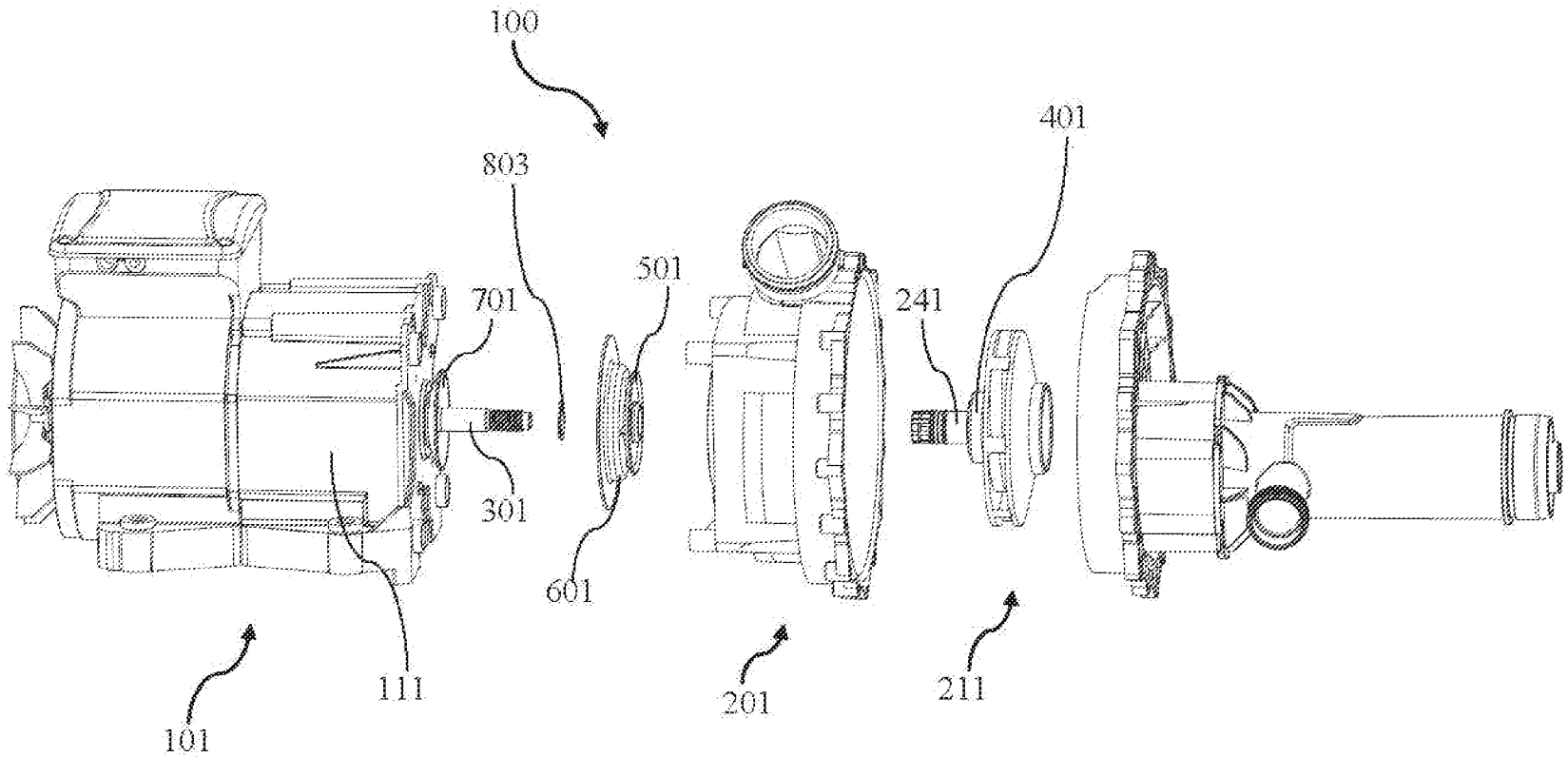
FIG. 1 is an exploded view of a pump according to an exemplary embodiment of the present disclosure.
Figure 2:
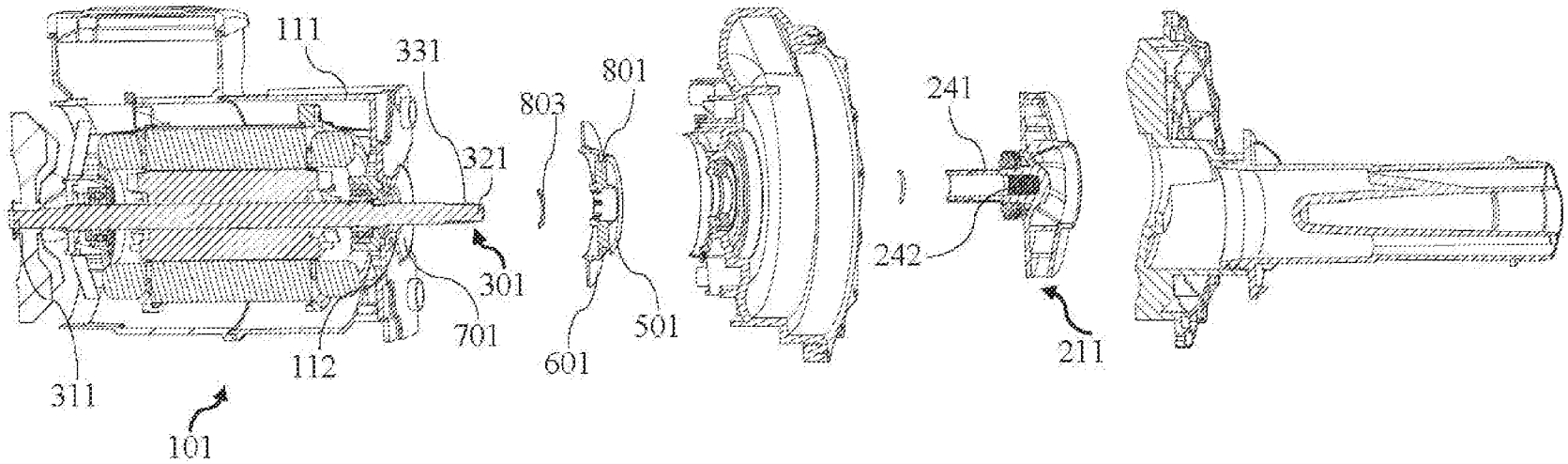
FIG. 2 is a cross-sectional view of the pump shown in FIG. 1.
Figure 3:
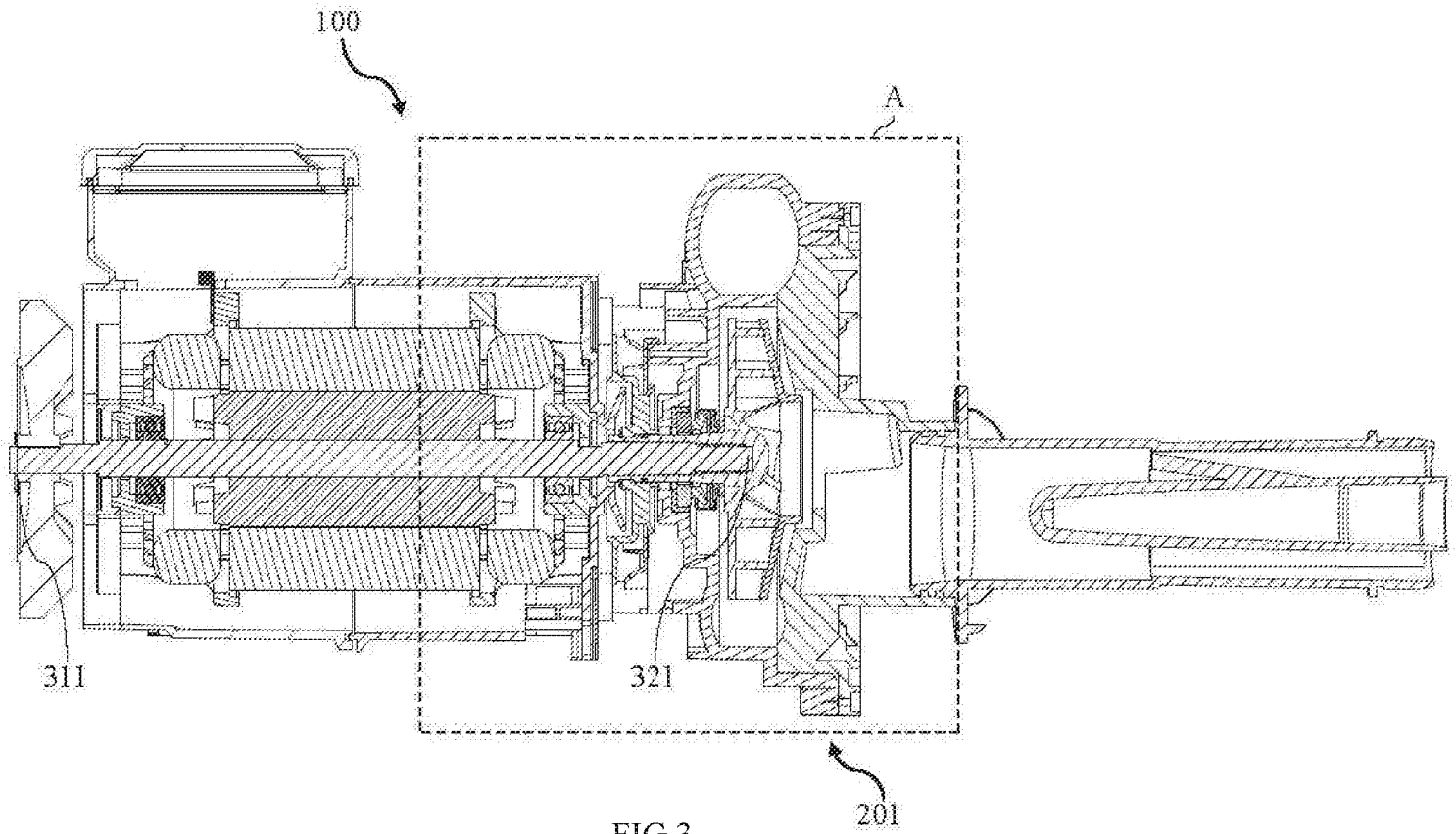
FIG. 3 is a cross-sectional view of the pump of FIG. 1 after assembly.

In the above drawings, the names of the parts indicated by the reference numerals are as follows:

100—pump, 101—motor, 111—motor housing, 112—opening portion, 201—pump body, 211—impeller, 221—first drainage chamber, 222—first drainage outlet, 231—pump body cover, 232—first extension portion, 233—second extension portion, 234—second drainage outlet, 241—shaft sleeve, 242—internal threads, 301—pump shaft, 311—pump shaft first end, 321—pump shaft second end, 331—external threads, 401—shaft seal, 501—first blocking member, 511—inclined surface, 601—second blocking member, 611—guiding surface, 612—blocking surface, 613—cavity, 614—wall portion, 621—second drainage chamber, 701—third blocking member, 801—reinforcing member, 802—through hole, 803—sealing member.

DETAILED DESCRIPTION OF THE INVENTION

Example embodiments will now be described more fully with reference to the accompanying drawings. In general, the subject embodiments are directed to a pump with a waterproof structure that prevents fluid from leaking into a motor of the pump. However, the example embodiments are only provided so that this disclosure will be thorough, and will fully convey the scope to those skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies may not be described in detail.

As shown in FIGS. 1 to 4, exemplary embodiments of the present disclosure provide a pump 100 with a waterproof structure. The pump 100 includes a motor 101, a pump body 201, a pump shaft 301, a shaft seal 401, and a first blocking member 501.

The motor 101 includes a motor housing 111 having an opening portion 112 from which the pump shaft 301 extends. The pump body 201 includes a first drainage chamber 221 having a first drainage outlet 222. An impeller 211 extends from the pump shaft 301. The pump shaft 301 includes a pump shaft first end 311 and a pump shaft second end 321 located opposite from the pump shaft first end 311. The pump shaft first end 311 is fixedly connected to the motor 101 and the pump shaft second end 321 is fixedly connected to the impeller 211 such that as the pump shaft 301 is driven by the motor 101, the impeller 211 also rotates. More specifically, the pump shaft 301 is a motor shaft and, in certain embodiments, it may also include an impeller shaft sleeve 241. The shaft seal 401 forms a fluid seal with the pump body 201 to prevent a fluid in the pump body from leaking. If and when the shaft seal 401 begins to fail, the first blocking member 501 blocks any leaking fluid. More specifically, the first blocking member 501 is located between the motor 101 and the shaft seal 401, and is connected to the pump shaft 301 in a sealing and a fixed manner to realize synchronous rotation with the pump shaft 301. As such, the first blocking member 501 and the pump shaft 301 do not move relative to each other, thereby preventing wear associated with a traditional shaft seal which may lead to seal failure. As explained above, continued use and other external factors may cause the shaft seal 401 to be damaged resulting in fluid leakage within the pump body 201. The first blocking member 501 blocks any fluid leaking from the shaft seal 401 and guides the blocked fluid to flow out along the first drainage outlet 222 through the first drainage chamber 221 of the pump body 201, as illustrated at least in FIGS. 4 and 5. In the present exemplary embodiments, the fluid may be water; however, in this and other embodiments, the fluid may be other types of liquid depending on the application and scenario.

Figure 4:
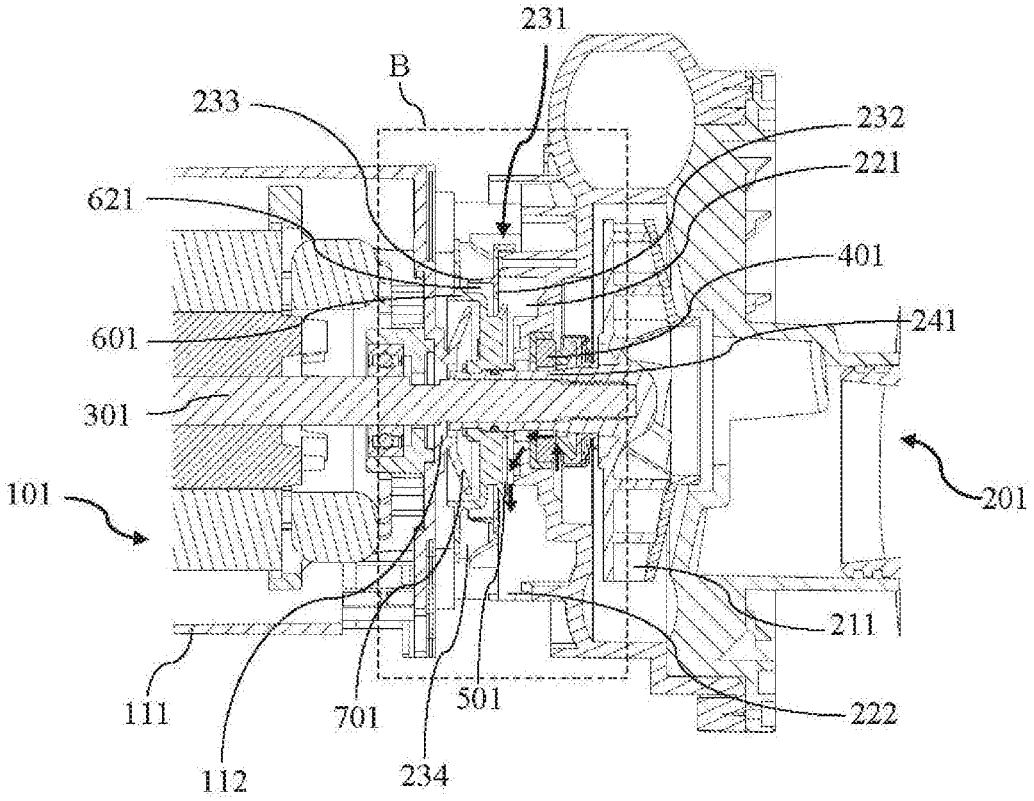
FIG. 4 is an enlarged cross-sectional view of an area A in FIG. 3.

In the event of failure of the shaft seal 401, the seal between the shaft seal 401 and the pump shaft 301 is compromised, allowing fluid in the pump body 201 to leak through the shaft seal 401, as indicated by way of example with the arrows in FIG. 4. Under the action of centrifugal force, the leaked fluid is forced against the first blocking member 501 and this blocked fluid is then deflected to the first drainage chamber 221 and directed out through the first drainage outlet 222. To this extent, the first blocking member 501 and the first drainage chamber 221 can act as a first line of defense to block leaked fluid from flowing to the motor 101.

Figure 5:
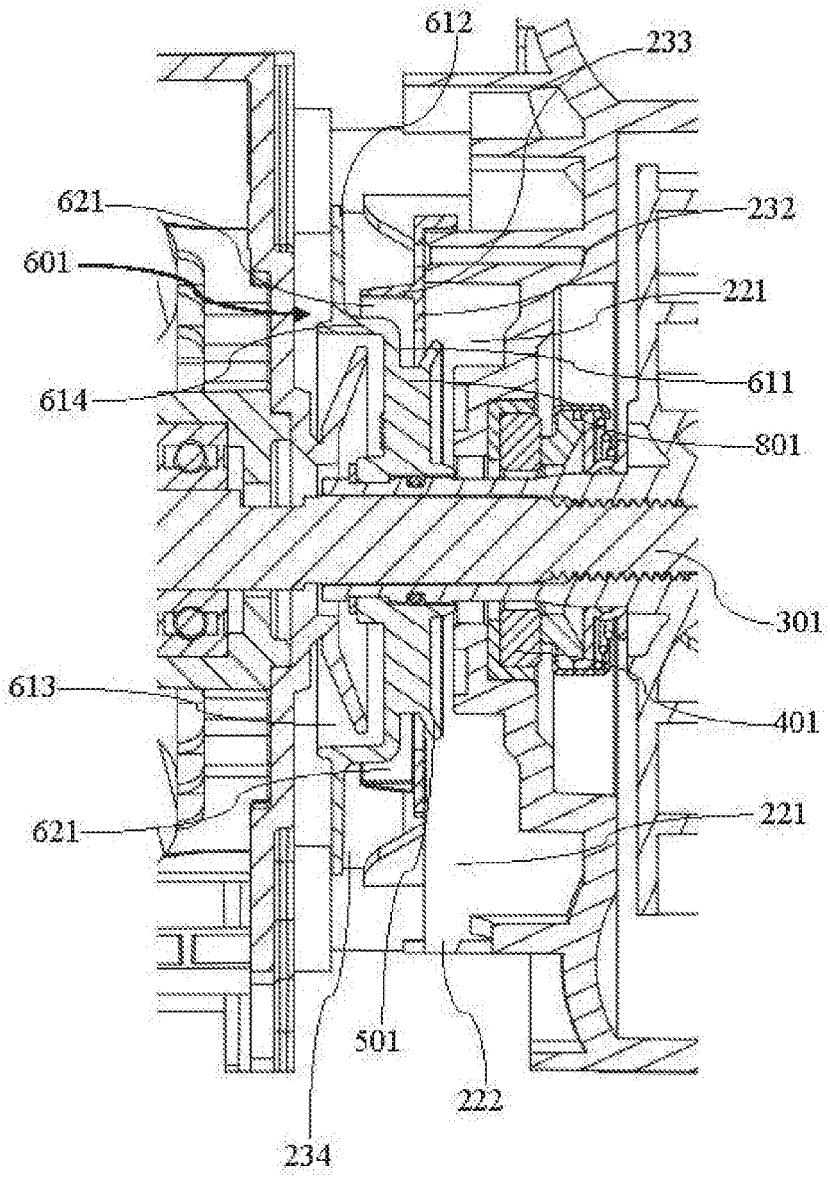
FIG. 5 is an enlarged cross-sectional view of an area B of FIG. 4, showing a first drainage chamber and a second drainage chamber.
Figure 6:
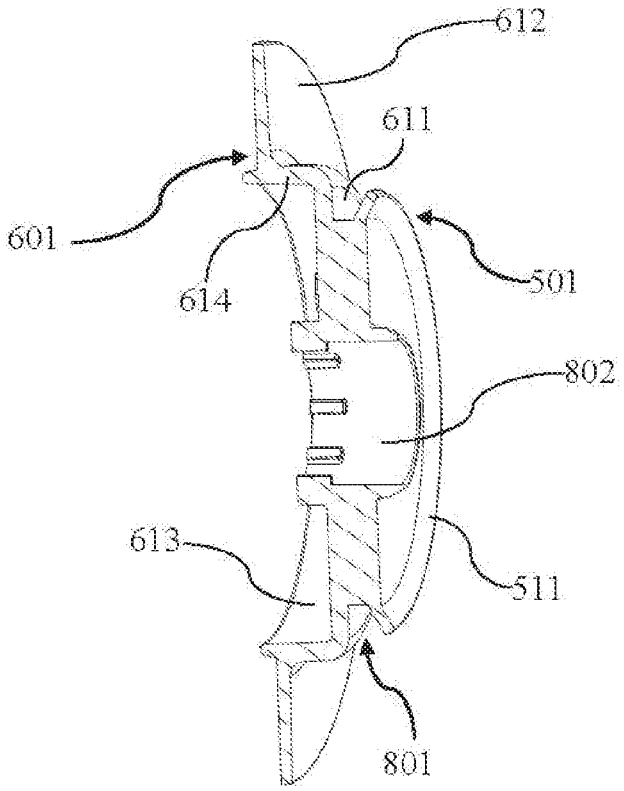
FIG. 6 is an enlarged cross-sectional view of a first blocking member, a reinforcing member and a second blocking member shown in FIG. 3.
Figure 7:
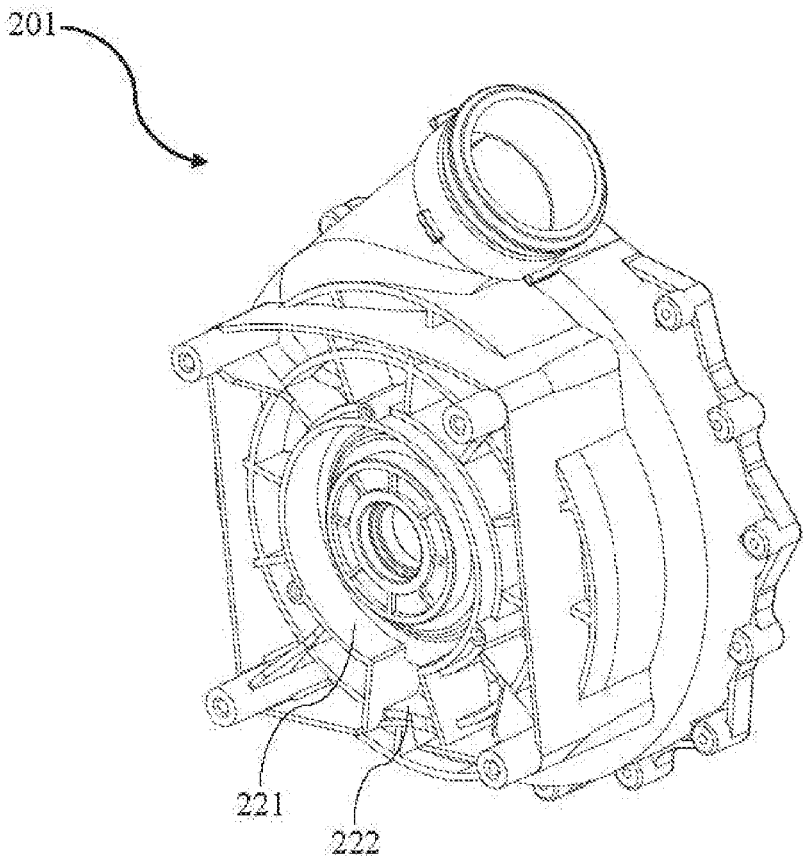
FIG. 7 is a perspective view of the pump body shown in FIG. 1, showing a first drainage outlet.
Figure 8:
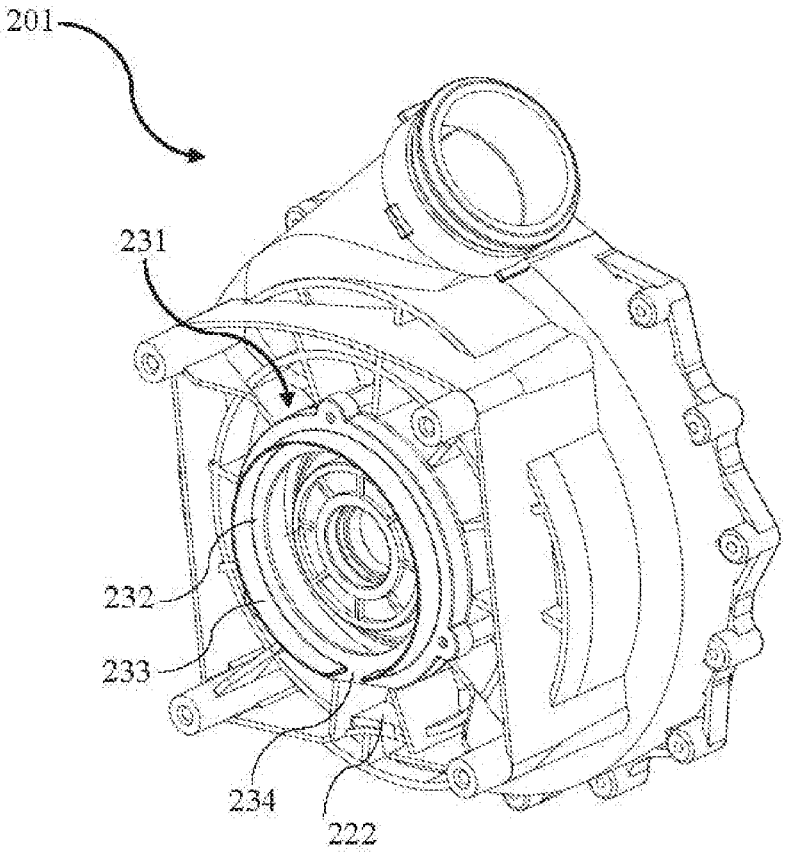
FIG. 8 is a perspective view of the pump body shown in FIG. 1, showing a second drainage outlet.
Figure 9:
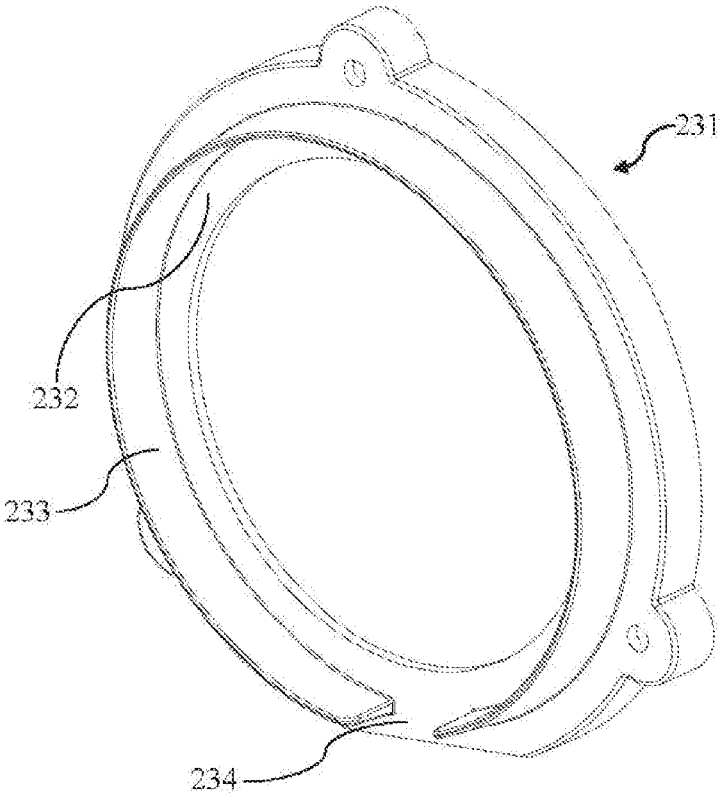
FIG. 9 is a perspective view of a pump body cover shown in FIG. 8.

In order to more effectively direct any deflected water through the first drainage chamber 221, the outer periphery (outer edge) of the first blocking member 501 may be at least partially located within the first drainage chamber 221, as shown by way of example in FIGS. 4 and 5. Further, as shown by way of example in FIG. 6, the first blocking member 501 may be annular in shape and extend axially to define an inclined surface 511 that may terminate at the outer periphery or outer edge. The inclined surface 511 may be at least partially received in the first drainage chamber 221 to help guide any fluid blocked/deflected by the first blocking member 501 to be directed into the first drainage chamber 221. Further, the first blocking member 501 may direct a portion of the fluid away from the first drainage chamber 221. In order to reduce or block the fluid from being directed away from the first drainage chamber 221, the pump body 201 further includes a pump body cover 231. The pump body cover 231 is mounted on the pump housing around an opening of the first drainage chamber 221 and includes a first extension portion 232 that extends radially inward toward the pump shaft 301 to catch and deflect fluid back into the first drainage chamber 221, as shown by way of example in FIG. 4. The first extension portion 232 is shown, by way of example, in the perspective views of the pump body 201 and pump body cover 231 (e.g., see FIGS. 7, 8 and 9). The first extension portion 232 may be used to direct any portion of fluid that was not blocked by the first blocking member 501 and deflect any such fluid back into the first drainage chamber 221.

The pump 100 further includes a second blocking member 601. The second blocking member 601 may also be located between the motor 101 and the shaft seal 401, and may be closer to the motor 101 than the first blocking member 501, as shown by way of example in FIGS. 1, 2, 4 and FIG. 5. The second blocking member 601 is located to block any fluid that may have leaked from the shaft seal 401 and past the first blocking member 501, the first drainage chamber 221, and the first extension portion 232 of the pump body cover. More specifically, the second blocking member 601 may include a guiding surface 611 and the pump 100 may further include a second drainage chamber 621 to provide a second line of leakage defense. The second blocking member 601 may deflect fluid into the first drainage chamber when any fluid has moved out of or bypassed around the first drainage chamber 221. The second blocking member 601 may also rotate with the pump shaft 301. In order to increase the structural strength of the first blocking member 501 and the second blocking member 601, the pump 100 may further include a reinforcing member 801 that may connect the first blocking member 501 and the second blocking member 601. In certain embodiments, the first blocking member 501, the second blocking member 601 and the reinforcing member 801 comprise an integrally formed member that may be fixed to the pump shaft 301 and form a fluid seal therewith. In an alternative embodiment, the first blocking member 501, the second blocking member 601, and the reinforcing member 801 may be separately formed and then sealingly and fixedly connected together and/or to the pump shaft 301 by any suitable connection means, such as by welding, gluing or any other desired technique. As shown by way of example in FIG. 4, the pump body cover 231 may extend along the axial direction of the pump shaft 301 to form a second extension portion 233 to help guide fluid in the second drainage chamber 621 to a second drainage outlet 234. The perspective views of separate pump body 201 and pump body cover 231 (see FIGS. 7, 8, and 9) show the second extension portion 233. The second blocking member 601 may further include a cavity 613 at least partially defined by a wall portion 614. As shown by way of example in FIGS. 5 and 6, the second drainage chamber 621 may be defined by a combination of the second extension portion 233, the first extension portion 232, the reinforcing member 801, the guiding surface 611 of the second blocking member 601, and a wall portion 614 of the cavity. The guiding surface 611 of the second blocking member 601 may guide any fluid directed out of or bypassing the first blocking member 501 to the second drainage chamber 621, and cause any such fluid to finally flow out along the second drainage outlet 234. In certain embodiments, the cavity may be at least partially defined by the guiding surface 611 and the wall portion 614. However, the present disclosure is not limited thereto, and the guiding surface 611 may not facilitate bounding of the cavity 613, but may be a surface of a separate member disposed between the cavity and the reinforcing member. In certain embodiments, however, the guiding surface 611 may be positioned to guide any fluid leaked past the first blocking member 501 to the second drainage chamber 621. For example, a disk-shaped or annular member may be provided between the cavity and the reinforcing member, as well as being received in the second drainage chamber. The second blocking member 601 may further include a blocking surface 612, as shown by way of example in FIGS. 5 and 6. The blocking surface 612 may extend to an outer edge that may extend the wall portion 614 of the cavity 613 away from the pump shaft 301. The guiding surface 611 and the blocking surface 612 may be disposed radially about the pump shaft 301, and both may be annular. The diameter of the blocking surface 612 may be larger than the diameter of the guiding surface 611, and the portion of the fluid that is directed out by the first blocking member 501 and is not blocked by the guiding surface 611 and the second drainage chamber 621 may be directed to the blocking surface 612. The blocking surface 612 then may deflect at least a portion of the fluid out of the pump 100. The present disclosure is not limited thereto, and the blocking surface 612 may extend from other portions of the cavity wall 614 as long as the blocking surface can block a portion of the fluid that bypasses and leaks by the first blocking member, the guiding surface 611, and the second drainage chamber 621. The guiding surface 611 and the blocking surface 612 can also have any other suitable shape. In alternative embodiments, the second drainage chamber 621 and the guiding surface 611 may not be provided, meaning that the second line of leakage defense may not be employed, in which case the portion of fluid directed out of the first drainage chamber 221 by the first blocking member 501 may be directed out of the pump 100 by the second blocking member 601. In other words, the second blocking member 601 can also be aligned with the first drainage chamber 221. Specifically, the portion of the fluid that is splashed out of the first drainage chamber 221 by the first blocking member 501 can be directly splashed out of the pump by the blocking surface 612 of the second blocking member 601. In other alternative embodiments, the second drainage chamber 621 and the guiding surface 611 may not be provided, and also the second blocking member 601 may not be provided with the blocking surface, in which case the portion of fluid that is directed out of the first drainage chamber 221 by the first blocking member 501 is blocked by a third line of leakage defense, as described below.

The pump 100 may further include a third blocking member 701 configured to prevent the fluid directed out, bypassed, or leaked from the second blocking member 601 from flowing into the opening portion 112 of the motor housing 111. In this configuration, the second blocking member 601 and the third blocking member 701 overlap to constitute a third line of leakage defense for the pump 100. Specifically, the third blocking member 701 is formed by extending outward from the opening portion of the motor housing 111, meaning that the third blocking member 701 may be integrally formed or otherwise connected with the motor housing 111. In alternative embodiments, the third blocking member 701 and the motor housing 111 may be separately formed, and then sealingly and fixedly connected by welding, gluing or the like. The third blocking member 701 may be formed as a frustoconical shape and extend radially outward and be completely or partially received in the cavity 613 of the second blocking member 601. As such, any fluid that bypasses the blocking surface 612 of the second blocking member 601 falls against the motor housing 111 it is prevented from entering into the opening portion 112 by the presence of the third blocking member 701, which extending axially towards the second blocking member 601. Accordingly, rather than fall into the opening portion 112 of the motor 101, the water flows away from the motor 101. Alternatively, when the second blocking member 601 does not have the blocking surface 612, any portion of fluid that is directed out of or bypasses the first drainage chamber 221 may contact the motor housing 111 and be deflected by the third blocking member 701 that surrounds the opening portion 112 rather than falling into the opening portion 112 of the motor 101. It is to be understood that the present disclosure is not limited thereto, and the third blocking member 701 may be of any other suitable shape. The third blocking member 701 does not have to be completely received in the cavity 613 as long as there is some axial overlap between an outer axial edge of the third blocking member 701 and an opening of the cavity 613 in order to help prevent fluid flowing into the opening portion 112. For example, a frustoconical opening of the third blocking member 701 may be disposed opposite to an opening of the cavity 613, and an outer periphery (outer edge) of the third blocking member 701 may be received in the cavity 613 to prevent any fluid being directed out by the second blocking member 601 from getting into the opening portion 112 of the motor 101.

In the present embodiments, the impeller 211 may include a shaft sleeve 241 that is formed by extending toward the motor 101 and used to mount the pump shaft 301 to the impeller 211. As such, in certain embodiments the pump shaft 301 may include the shaft sleeve 241. The shaft sleeve 241 has internal threads 242, and the pump shaft 301 has external threads 331 mating with the internal threads 242. In certain embodiments, the shaft sleeve 241 may be detachably fixed to the pump shaft 301 by the internal threads 242 and the external threads 331, so as to run synchronously with the pump shaft 301. The geometric centers of the first blocking member 501, the second blocking member 601 and the reinforcing member 801 have at least one aperture. Alternatively each of these elements have an aperture for accepting the pump shaft 301, or three apertures total, that collectively form a through hole 802. The first blocking member 501, the second blocking member 601, and the reinforcing member 801 may be sleeved on the outer surface of the shaft sleeve 241 through the through hole 802 to all rotate with the pump shaft 301. A sealing member 803 may be disposed between the reinforcing member 801 and the shaft sleeve 241 to form a fluid seal with the shaft sleeve 241. In an alternative embodiment, a sealing member may also be disposed between the shaft sleeve and at least one of the first blocking member 501 and the second blocking member 601. In still another alternative embodiment, a sealing member may be provided between the shaft sleeve 241 and at least one of or each of the first blocking member 501, the second blocking member 601, and the reinforcing member 801.

In order to prevent the fluid leaking from the shaft seal from flowing into the motor 101, the present disclosure is not limited to the three lines of leakage defense in the above exemplary embodiments. In an alternative embodiment, the pump 100 of the present disclosure may not be provided with the above-described first line of leakage defense, and may be only provided with the above-described second line of leakage defense, and/or the above-described third line of leakage defense.

The pump of the present disclosure is provided with a sealed waterproof structure that may run synchronously with the pump shaft, and the sealed waterproof structure can effectively prevent fluid leaking from the shaft seal from flowing into the motor; and the sealed waterproof structure may run synchronously with the pump shaft, thereby avoiding the seal failure of the sealed blocking structure to cause fluid to flow into the motor.

Although some exemplary embodiments have been described herein, various modifications may be made to these embodiments without departing from the spirit of the disclosure, and all such modifications still belong to the concept of the present disclosure and fall within the scope of the present disclosure.

The specific embodiments disclosed herein are merely used to illustrate the disclosure, and it will be apparent to those skilled in the art that various modifications may be made in accordance with the teachings herein, and the disclosure may be practiced in various equivalents. Thus, the specific embodiments of the disclosure disclosed above are illustrative only, and the scope of the disclosure is not limited by the details of the structure or design disclosed herein, unless otherwise stated in the claims. Accordingly, the specific exemplary embodiments disclosed above may have various alternatives, combinations and modifications, and all fall within the scope of the disclosure. The pump disclosed herein, by way of example, may still be suitably implemented in the absence of any component not specifically disclosed herein or in the absence of optional components disclosed herein. All values and ranges disclosed above may also vary. Whenever a numerical range with a lower limit and an upper limit may be disclosed, any numerical value falling within the range and any subsets of the range are specifically disclosed. Specifically, any range of values disclosed herein can be understood to comprise any value and range that is encompassed within the broader numerical range. Likewise, the terms in the claims have their clear and ordinary meaning unless the applicant clearly and definitely dictates otherwise.

Additionally, the number of the members in the claims comprises one or at least one unless otherwise stated. If the words or terms used in the present specification are inconsistent with the usage or meaning in other documents, the definitions of the present disclosure shall prevail.

What is claimed is:

1. A water pump, comprising:

a motor housing including a first end surface;

a motor accommodated in the motor housing and including a motor shaft;

a pump body fixed on the first end surface of the motor housing and including an impeller chamber and a drainage chamber opposite to the impeller chamber, wherein the drainage chamber is a first drainage chamber comprising a second drainage chamber;

an impeller having a shaft seal, accommodated in the impeller chamber of the pump body and fixed on the motor shaft of the motor, wherein the impeller and the impeller chamber of the pump body are sealed by the shaft seal of the impeller;

a blocking member coupled to the motor shaft of the motor and disposed in the drainage chamber of the pump body, the blocking member comprising:

a first annular ring comprising an inclined surface partially disposed in the drainage chamber, and a second annular ring which extends radially outward from the first annular ring and is integrally formed with the first annular ring, wherein the blocking member is configured to rotate synchronously with the motor shaft; and an annular wall inside the first drainage chamber and a notch on a lower position of the annular wall, wherein a side of the annular wall inside the second drainage chamber of the first drainage chamber and the second annular ring of the blocking member form the second drainage chamber.

2. The water pump according to claim 1, wherein the first annular ring of the blocking member is closer to the shaft seal of the impeller than the second annular ring.

3. The water pump according to claim 2, wherein the inclined surface inclines towards the shaft seal of the impeller.

4. The water pump according to claim 1, wherein the drainage chamber of the pump body includes a peripheral wall and a gap on a lower position of the peripheral wall.

5. The water pump according to claim 1, wherein the impeller is threaded on the motor shaft.

6. The water pump according to claim 1, further including a guidance member disposed on the first end surface of the motor housing.

7. The water pump according to claim 6, wherein the guidance member is an annular ring and fixed on the first end surface of the motor housing.

8. A water pump, comprising:

a motor housing including a first end surface;

a motor accommodated in the motor housing and including a motor shaft;

a pump body having a through hole, fixed on the first end surface of the motor housing and including an impeller chamber and a drainage chamber opposite to the impeller chamber, wherein the drainage chamber is a first drainage chamber comprising a second drainage chamber;

an impeller having a shaft seal, accommodated in the impeller chamber of the pump body and fixed on the motor shaft of the motor, wherein the impeller and the impeller chamber of the pump body are sealed by the shaft seal of the impeller;

a blocking member driven by the motor shaft of the motor and disposed in the drainage chamber of the pump body, the blocking member comprising:

a first annular ring comprising an inclined surface partially disposed in the drainage chamber, and a second annular ring which extends radially outward from the first annular ring and is integrally formed with the first annular ring, wherein the blocking member is configured to rotate synchronously with the motor shaft;

wherein the motor shaft passes through the blocking member and the through hole of the pump body, and is threaded to the impeller; and an annular wall inside the first drainage chamber and a notch on a lower position of the annular wall, wherein a side of the annular wall inside the second drainage chamber of the first drainage chamber and the second annular ring of the blocking member form the second drainage chamber.

9. The water pump according to claim 8, wherein the first annular ring of the blocking member is closer to the shaft seal of the impeller than the second annular ring.

10. The water pump according to claim 9, wherein the inclined surface inclines towards the shaft seal of the impeller.

11. The water pump according to claim 8, wherein the drainage chamber of the pump body includes a peripheral wall and a gap on a lower position of the peripheral wall.

12. The water pump according to claim 8, further including a guidance member disposed on the first end surface of the motor housing.

13. The water pump according to claim 8, wherein the motor shaft of the motor includes a sleeve to couple with the impeller.

* * * * *